United States Patent [19]

Ozaki et al.

[11] 4,357,390

[45] Nov. 2, 1982

[54] ANTISTATIC POLYESTER FIBERS

[75] Inventors: Kiyotaka Ozaki, Takatsuki; Michikage Matsui, Ibaraki, both of Japan

[73] Assignee: Teijin Limited, Osaka, Japan

[21] Appl. No.: 245,183

[22] Filed: Mar. 18, 1981

[30] Foreign Application Priority Data

Mar. 25, 1980 [JP] Japan ..... 55/36921
Nov. 4, 1980 [JP] Japan ..... 55/153823
Nov. 4, 1980 [JP] Japan ..... 55/153824

[51] Int. Cl.[3] ..... D02G 3/00

[52] U.S. Cl. ..... 428/398; 57/901; 264/177 F; 428/224

[58] Field of Search ..... 428/376, 398, 373, 364, 428/224; 57/901; 264/177 F; 260/DIG. 23, DIG. 15

[56] References Cited

U.S. PATENT DOCUMENTS 2,393,863 1/1946 Myers ..... 260/DIG. 15
3,329,557 7/1967 Magat et al. ..... 260/DIG. 15
3,558,420 1/1971 Opfell ..... 428/398
3,718,534 2/1973 Okamoto et al. ..... 428/374
3,743,685 7/1973 Grosjean et al. ..... 260/DIG. 15
3,745,061 7/1973 Champaneria et al. ..... 428/398

FOREIGN PATENT DOCUMENTS 45-2972 1/1970 Japan ..... 260/DIG. 15

*Primary Examiner*—Lorraine T. Kendell
*Attorney, Agent, or Firm*—Burgess, Ryan and Wayne

[57] ABSTRACT

A hollow polyester fiber with excellent antistatic properties composed of a single polymeric component and having a hollow extending along the longitudinal axis thereof and in which the hollow ratio is at most 15%, which fiber contains (a) a polyoxyalkylene glycol substantially non-reactive with said polyester and (b) an ionic antistatic agent, dispersed through the fiber in an amount of at most 3% by weight based on the weight of the fiber, and wherein the polyoxyalkylene glycol (a) is predominantly dispersed in a core portion of the fiber in a high density. The fiber also has excellent tensile strength, resistance to fibrillation and dyeing properties.

12 Claims, 4 Drawing Figures

ANTISTATIC POLYESTER FIBERS

BACKGROUND OF THE INVENTION

1. Field of the Invention

The present invention relates to antistatic polyester fibers. More particularly, the present invention relates to hollow antistatic polyester fibers consisting of a single component and in which antistatic agents are dispersed in a high density around the hollow of the fiber.

2. Description of the Prior Art

Synthetic fibers the typical example of which is a polyester fiber are superior in various properties, such as mechanical strength, durability and function, to natural fibers. However, the polyester fibers have a fatal disadvantage in that they are liable to charging with static electricity because of their high electrical resistance.

Various methods have been heretofore proposed to prevent the synthetic fibers from being charged with static electricity. However, these methods all have advantages and disadvantages. That is, it is the state of the art that the conventional methods are not completely satisfactory in respect of yarn-making cost, antistatic property and durability thereof, and the physical properties of the resultant fibers. The simplest conventional method comprises spreading or applying an antistatic agent on the surface of the fiber. This method is disadvantageous in that the antistatic agents deposited on the surface of the fiber are liable to be removed during the dyeing step or repeated washings, and thus, a permanent antistatic property can not be imported to the fiber.

If focus is directed only to the antistatic property of the synthetic fibers, the durability of the antistatic property is a basic requisite. In this sense, it can be stated that a preferable method for rendering the synthetic fibers antistatic is to incorporate antistatic agents into the synthetic resins from which the fibers are made before spinning. In this regard, the following means are well known. That is, (a) Japanese Patent Application Publication No. 39-5214 discloses incorporating uniformly a polyoxyalkylene glycol into synthetic resins; (b) Japanese Patent Application Publication Nos. 47-11280, 46-22200 and 47-10246 disclose incorporating a mixture of a polyoxyalkylene glycol and sodium alkylbenzenesulfonate into synthetic resins and (c) Japanese Patent Application Laid-open No. 53-149247 discloses incorporating a mixture of a polyoxyalkylene glycol and a sodium alkyl sulfonate into synthetic resins. These publications generally recommend that the antistatic agents are used in amounts of 2% by weight or more ((a)), from 0.7 to 8% by weight ((b)) and from 1.0 to 2.0% by weight ((c)), respectively. It is necessary, however, to use a relatively large amount of the antistatic agent in order to attain a practical antistatic effect. That is, the method (a) requires 6% by weight or more; the method (b) about 7.5% by weight and the method (c) 3% by weight, as disclosed in the respective examples. The use of such a large amount of the antistatic agent results in not only the deterioration of the mechanical properties of the resultant fiber itself, but also a reduction in fastness when the fiber is dyed. In addition, the conventional antistatic agents inevitably have a high affinity to water. Accordingly, when a knitted or woven fabric made from the fibers resulting from the above mentioned methods is subjected to a scouring, dyeing or washing procedure involving the use of water, the antistatic agents present in the interior of the fiber are dissolved out from the surface of the fiber, which results in a rapid decrease in the antistatic property of the fabric for this reason, in practice, it is necessary to use the antistatic agent in amounts large enough to compensate for such loss, which results in an increasing deterioration in the physical properties of the resultant fiber.

Among the decreased physical properties of the fiber, a most serious disadvantage which can not be overlooked is the fibrillation of the fiber which is high in the polyester fibers. This phenomenon is due to the fact that the polyester fiber essentially has a poor compatibility with the antistatic agent. In particular, when the amount of antistatic agent used is about 4% by weight or more, the resultant fiber is liable to be fibrillated and this propensity is further provided by mechanical action exerted on the fiber.

In order to prevent the deterioration of the physical properties of the fiber, a composite spinning method for preparing a core-in-sheath type fiber is known. In this method, at least two types of polymers are used. The sheath component comprises a homopolymer, while the core component comprises the same or a different polymer containing a large amount of an antistatic agent, a polymer containing a significant amount of an electric conductive material such as carbon or metals, or a polymer which has undergone a high degree of chemical modification. In this type of fiber, even if the amount of antistatic agent used is decreased, an excellent antistatic property can be obtained without having an adverse effect on the mechanical properties and dyeing property of the fiber. However, as has been previously indicated, this method has a great disadvantage in that it is remarkably costly to prepare the fiber, which makes it impossible to put it to practical use.

Notwithstanding that a number of methods for rendering the synthetic fibers antistatic, such as the spreading method, the incorporating method and the composite spinning method, have been proposed since the appearance of the fibers, none of these methods could have simultaneously satisfied the above mentioned requirements such as the practical level of antistatic effect, and the durability thereof; the high mechanical strength, resistance to fibrillation, excellent dyeability and low cost of yarn-making.

SUMMARY OF THE INVENTION

The primary object of the present invention is to provide an antistatic polyester fiber having not only long-lasting antistatic property, but also a high mechanical strength, a high resistance to fibrillation, and an excellent dyeability, particularly, ability to exhibit an excellent color tone (clarity) where dyed, by overcoming the antinomic problem lying between the antistatic property and the mechanical and chemical properties without resorting to a composite spinning method.

In the course of the realization of the above mentioned object, the inventors of the present invention have studied how to obtain a desirable antistatic effect with a smaller amount of an antistatic agent. This is because when desirable functions are to be imported to a polyester fiber consisting of a single component without resorting to a composite spinning method, the antistatic agent should be inevitably used in an amount as small as possible, which is accompanied by a reduction in the antistatic property of the resultant fiber. As a result of their studies, the inventors of the present invention have found that when the antistatic agents are concentrated at a particular region of the cross section of the fiber instead of dispersing the antistatic agents uniformly throughout the cross section of the fiber, even if the amount of antistatic agent used is smaller than that used in the conventional antistatic fibers, the antistatic property of the resultant fiber is remarkably improved.

Thus, the present invention provides a hollow antistatic polyester fiber composed of a single polymeric component, having a hollow extending along the longitudinal axis thereof, the hollow ratio being at most 15%, and containing (a) a polyoxyalkylene glycol substantially non-reactive with said polyester and (b) an ionic antistatic agent, dispersed through the fiber in an amount of at most 3% by weight based on the weight of the fiber, characterized by the presence of a highly conductive core portion formed by the predominant dispersion of the polyoxyalkylene glycol (a) around said core in a high density.

DESCRIPTION OF THE PREFERRED EMBODIMENTS

Figure 1:
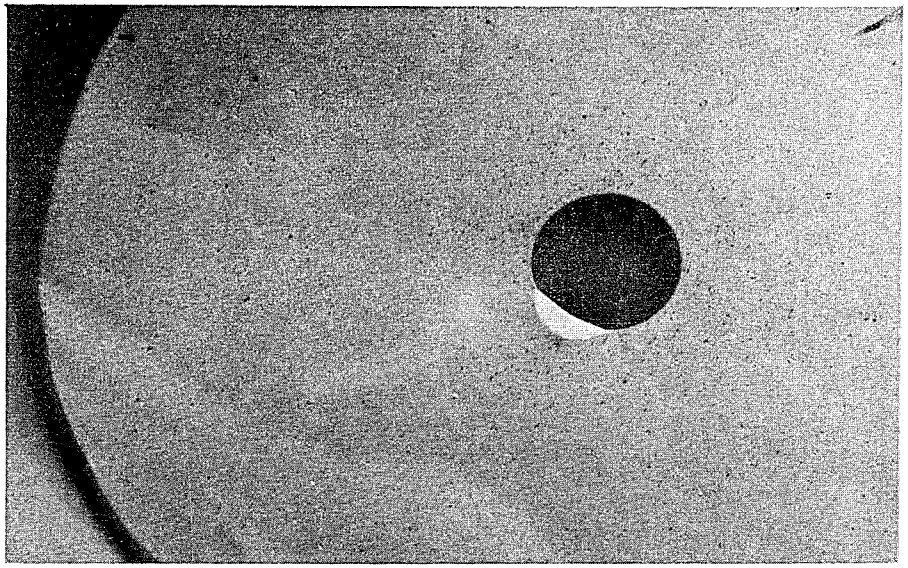
FIG. 1 is an enlarged view (electron micrograph at a magnification of 10,000) of a part of the transverse cross section of an antistatic polyester fiber according to the present invention.

The present invention is based on the concept that when the antistatic agent is dispersed in a relatively high density at a particular portion of the cross section of the fiber, a satisfactory antistatic effect can be attained without having a substantial adverse effect on the physical properties of the fiber. This concept of the present invention is quite different from the conventional concept of dispersing a large amount of the antistatic agents uniformly throughout the cross section of the fiber. The inventors of the present invention have found that such fiber can be obtained by coupling a combination of antistatic agents with a particular spinning method. That is, the inventors of the present invention have found that when a hollow fiber is spurn from a molten polymer containing an antistatic agent consisting of a polyoxyalkylene glycol and an ionic antistatic agent, the ionic antistatic agent is almost uniformly dispersed throughout the cross section of the resultant fiber, while the major portion of the polyoxyalkylene glycol is condensed around the hollow of the resultant fiber. That is, the polyoxyalkylene glycol presents a specific phenomenon of one type of "Bleed out". The above mentioned discovery is quite surprising in the light of the conventional concept that the antistatic agent is uniformly dispensed throughout the cross section of the fiber. This phenomenon can be caused only by utilizing a coupling of a combination of the antistatic agents with a hollow spinning technique. Although the reason for this has not been clear as yet, it is considered that the ionic antistatic agent serves to promote the bleed-out of the polyoxyalkylene glycol only when a hollow fiber is spun from a molten polymer containing these antistatic agents. Also, the polyoxyalkylene glycol usually bleeds out at a region around the hollow of the fiber, i.e. a hollow core portion, which extends from the center of the fiber to about a one-half of the radius of the fiber. This concentrated dispersion makes it possible to enhance the antistatic property of the resultant fiber while causing the amount of the antistatic agents to be reduced. This advantage will be illustrated by an example.

Supposing that the radius of the conventional fiber is r and the amount of polyalkylene glycol used is X, the average density (Xa) of the antistatic agent in the corss-sectional direction of the fiber is represented by $X/\pi r^2$.

On the other hand, supposing that a hollow fiber having a radius of r and a hollow ratio of 5% contains a polyalkylene glycol in an amount of X and one-half (X/2) of the polyalkylene glycol bleeds out at a region extending from the center of the fiber to r/3, i.e. a small circle having a radius of r/3, the density (X6) of the polyalkylene glycol within the small circle is represented by the following equation:

$$Xb = \frac{X/2}{\pi(\frac{1}{3}r)^2 - \pi r^2 \times \frac{5}{100}}$$

$$\approx 8.8\, X/\pi r^2$$

Also, the density (Xc) of the polyalkylene glycol within a ring surrounding the bleed-out region is represented by the following equation:

$$Xc = \frac{X/2}{r^2 - \pi(\frac{1}{3}\gamma)^2}$$

$$\approx \frac{1}{2} \cdot \frac{X}{\pi r^2}$$

The foregoing will be summarized as follows.

1. Even if the amount (X) of the polyoxyalkylene glycol is the same, the glycol density within the hollow core portion of the hollow fiber according to the present invention is about 9 times that of the core portion of the conventional fiber and the glycol density of the peripheral portion around the hollow core portion is about ½ times that by the peripheral portion around the core portion of the conventional fiber.

2. Even if the amount of the polyoxyalkylene glycol is reduced to one-half (X/2) for the follow fiber according to the present invention, the glycol density of the hollow core portion of the hollow fiber is as high as about 4.4 times that of the core portion of the conventional fiber, while the glycol density of the peripheral portion around the hollow core portion is as low as ¼ times that of the peripheral portion around the core portion of the conventional fiber. Accordingly, the hollow fiber of the present invention remarkably improved in respect to antistatic property, physical properties, particularly resistance to fibrillation, dyeability and color tone, as compared with the conventional antistatic fiber.

Figure 2:
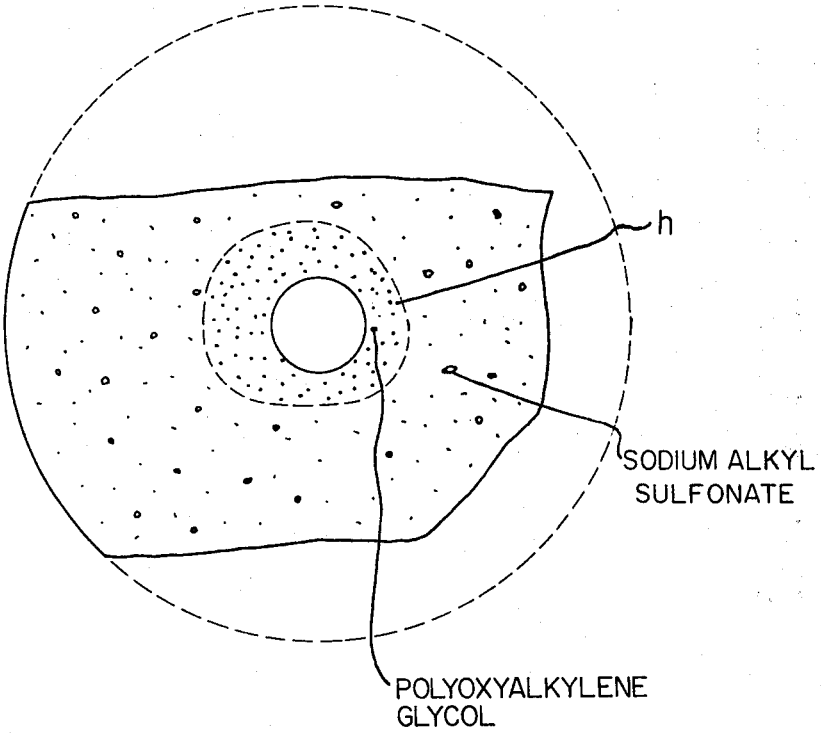
FIG. 2 is a sketch of FIG. 1.

The present invention will be illustrated in a more concrete form. FIG. 1 is an electron microphotograph of a portion of the transverse cross section of an antistatic fiber having a monofilament denier of 2.1 d according to the present invention at a magnification of 10,000. The fiber comprises a polyethylene terephathalate and as an antistatic agent, a 2:1 mixture of a polyoxyalkylene glycol having a molecular weight of 20,000 and a sodium alkylsulfonate having 12 to 13 carbon atoms, which mixture is added in an amount of 0.9 part by weight with respect to the weight of the fiber. In FIG. 1, the white finely-divided particles which are almost uniformly dispersed throughout the cross section of the fiber indicate the sodium alkylsulfonate. On the other hand, the finer particles in the form of a black dot indicate the polyoxyalkylene glycol which is concentrated at a region around the hollow of the fiber in a much higher density than that at the other, regions of the fiber. FIG. 2 is a sketch of the microphotograph shown in FIG. 1. Referring to FIG. 2, the black dot indicates the polyoxyalkylene glycol, while the white blank dot indicates the sodium alkylsulfonate. The interior of the circles represented by the broken line indicates a so-called hollow core portion (h) at which the polyoxyalkylene glycol bleeds out in a high density. It is to be noted that the density of the polyoxyalkylene glycol within the hollow core portion gradually increases toward the peripheral wall of the hollow. The presence of such a core portion in the fiber is effective for enhancing the antistatic property of the fiber for the following reasons: the polyoxyalkylene glycol is bled out in the vicinity of and/or deposited onto the peripheral wall of the hollow continuously extending in the longitudinal direction of the fiber, so as to form a substantially continuous layer of the antistatic agent therein; electric charges generated on the surface of the fiber move to the continuous layer due to dielectric breakdown, and; the moved charges escape while passing through the continuous layer in the longitudinal direction of the fiber.

The term "substantially continuous layer" as used herein refers to a layer in the vicinity of the peripheral wall of the hollow in which the antistatic agents are bled out so as to form an aggregation of the antistatic agents suitable for allowing the electric charges to pass therethrough. As far as the condition of the continuous layer is concerned, it is to be understood that the conductivity of the continuous layer is increased as the weight ratio of the antistatic agent contained in the continuous layer to the total antistatic agent contained in the fiber is increased.

It is well known that a fiber is provided with a hollow for the purpose of improving the bulkiness thereof or enhancing the crimpability thereof. It is also known that a membrane made of hollow fibers is utilized for separation of materials by reverse osmosis, dialysis or ultrafiltration. In addition, it is known that a hollow water-absorbing fiber is produced by preparing a hollow fiber containing addtives capable of being dissolved out and bringing the fiber into contact with a particular solvent to dissolve out the additives from the fiber, thereby forming fine pores communicating with the hollow of the fiber. All of the above mentioned purposes are attained by increasing the hollow ratio of the fiber.

However, it is never known that an improved antistatic property can be obtained by providing a hollow fiber wherein antistatic agents are bled out in the vicinity of the peripheral wall of the hollow continuously extending in the longitudinal direction of the fiber, so as to form a substantially continuous layer of the antistatic agent therein.

An example of the preparation of the antistatic polyester fiber according to the present invention will be illustrated below.

The polyester constituting the substrate of the fiber of the present invention may be selected from the group consisting of polyalkylene terephthalates and polyalkylene naphthalates. Among them, preferable polyesters are those polyesters which are composed of a main acid component consisting of terephthalic acid and a glycol component consisting of at least one glycol selected from alkylene glycols containing 2 to 6 carbon atoms, i.e. ethylene glycol, trimethylene glycol, tetramethylene glycol, pentamethylene glycol and hexamethylene glycol. These polyesters can be prepared by any conventional process. For example, in the case of polyethylene terephthalate, a terephthalic ethylene glycol ester and/or a lower polymerization product thereof is prepared by directly esterifying terephthalic acid with ethylene glycol, or by ester-exchanging a lower alkyl ester of terephthalic acid, for example, dimethyl terephthalate, with ethylene glycol, or by reacting terethalic acid with ethylene oxide. Then, the ester or the lower polymerization product is condensed under a reduced pressure at an elevated temperature to provide the polyethylene terephthalate having a desired degree of polymerization.

In the polyesters usable for the present invention, a portion of the terephthalic acid component may be replaced with other di-functional carboxylic acids. The di-functional carboxylic acid may be selected from the group consisting of di-functional aromatic carboxylic acid, such as isophthalic acid, phthalic acid, dibromoterephthalic acid, naphthalene dicarboxylic acid, diphenyldicarboxylic acid, diphenoxyethane dicarboxylic acid, β-hydroxyethyoxy benzoic acid and p-hydroxybenzoic acid; di-functional aliphatic carboxylic acids, such as sebasic acid, adipic acid and oxalic acid; and; di-functional cycloaliphatic dicarboxylic acids, such as 1,4-cyclohexane dicarboxylic acid. In the polyesters usable for the present invention, a portion of the glycol component may also be replaced with other glycols. Such glycol may be selected from the group consisting of aliphatic, cycloaliphatic and aromatic diols, such as cyclohexane-1,4-dimethanol, neopentyl glycol, bisphenol A, bisphenol S and 2,2-bis[3,5-dibrome-4-(2-hydroxyethoxy)phenyl]propane. The above mentioned polyester may be blended with a small amount of ether polymers, as required. Such polymer blend is included within the category of the single component as defined herein.

Then, a polyoxyalkylene glycol and an ionic antistatic agent are added to the above mentioned polyester and the resultant polyester is subjected to a spinning operation. Thus, the antistatic polyester fiber according to the present invention is obtained.

It is necessary that the polyoxyalkylene glycol should be substantially non-reactive with the polyester. The term "substantially non-reactive" as used herein signifies that the polyoxyalkylene glycol is not copolymerizable with the polyester.

If the polyoxyalkylene glycol is reactive with the polyester, uniform mixing of these components is hindered.

The polyoxyalkylene glycol usable for the present invention is preferably selected from the group consisting of polyoxyethylene glycols having an average molecular weight of 6,000 or more, more preferably, 10,000 or more, and polyoxyalkylene glycols comprising at least 50 molar % of an ethylene oxide unit and the remainder of other oxyalkylen units such as propylene oxide unit.

The terminal of the polyoxyalkylene glycol may be a hydroxyl group, or it may be capped with a nonester-forming organic group, or it may be linked to other ester-forming organic group via an ether linkage, an ester linkage or a carbonate linkage. If the terminal of the polyoxyalkylene glycol is capped with a nonester-forming organic group, the polyoxyalkylene glycol may have a low average molecular weight of from 800 to 4,000.

The content of the polyoxyalkylene glycol in the polyester is at most 2% by weight, preferably, at most 1% by weight.

The ionic antistatic agent which may be used in combination with the polyoxyalkylene glycol in the present invention may be selected from the group consisting of anionic antistatic agent, cationic antistatic agents and mixtures thereof. Examples of the ionic antistatic agent are polyethylene glycol, polybutylene glycol, poly(-metal alkyl, aryl or alkylaryl sulfonates), poly(alkyl, aryl or alkylaryl amines) and alkylene oxide adducts of poly(alkyl, aryl or alkylaryl amines). Among these, anionic antistatic agents containing a group $-SO_3M$ are preferable. Particularly preferable anionic antistatic agents are metal salts of alkylaryl or aralkyl sulfonic acids which are represented by the formula:

$$RSO_3M$$

wherein R represents an alkyl radical having at least 8 carbon atoms and M represents an alkali metal such as sodium, potassium and lithium, preferably, sodium. When the alkyl radical has 7 or less carbon atoms in the above formula, the compatibility of such metal salt with the polyester becomes slightly poor. Usually, metal salts of the above formula wherein R has 8 to 20 carbon atoms are used and mixtures of these metal salts are often used.

The content of the metal salt of the alkyl sulfonic acid in the polyester is at most 1.0% by weight, preferably, 0.5% by weight.

The total content of the polyoxyalkylene glycol and the ionic antistatic agent which are contained in the polyester is at most 3% by weight, preferably, 1.5% by weight, more preferably, 1.2% by weight, in consideration of physical properties of the resultant polyester fiber. In the mixture of the polyoxyalkylene glycol and the ionic antistatic agent, the polyoxyalkylene glycol is preferably present in an amount of from 50 to 90% by weight, based on the weight of the mixture. Also, it is necessary that the content of the mixture in the polyester should be at least 0.2% by weight. If the mixture content is less than 0.2% by weight, whatever ratio of the polyoxyalkylene glycol to the ionic antistatic agent is used or whatever hollow rate of the resultant fiber is used, the intended antistatic effect can not be obtained.

The polyoxyalkylene glycol and the ionic antistatic agent may be incorporated into the polyester by any conventional method. These materials may be incorporated simultaneously or in any order into the polyester. That is, these antistatic agents may be added simultaneously or in any order to the polyester in the state of a melt or finely divided particles at any stage before the completion of the spinning operation, e.g. before the start of the polycondensation reaction for the preparation of the polyester, during and at the end of the polycondensation reaction, and during the spinning operation. These antistatic agents may be added in the form of a melt. Also, these antistatic agents may be divided into two or more portions and the thus divided portions may be gradually added. Alternatively, these antistatic agents may be previously separately added to the polyester and the resultant polyesters may be mixed together before spinning them. In addition, when these antistatic agents are added before the middle stage of the polycondensation reaction, a solution or dispersion of these agents in a solvent such as glycol may be used.

Figure 3:
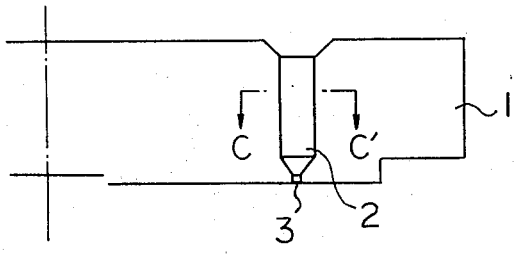
FIG. 3 is a cross-sectional view of an example of the spinneret usable for the production of the fiber of the present invention; and, FIG. 4 is a cross-sectional view of the spinneret in FIG. 3 taken along the line c-c'.
Figure 4:
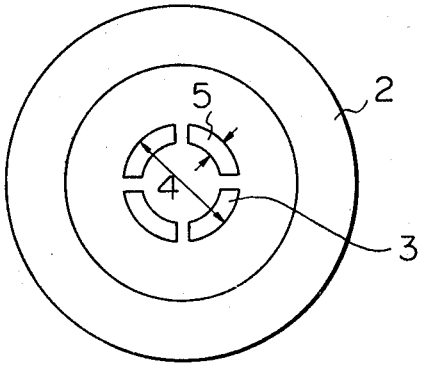

The thus-prepared polyester is converted to a hollow fiber by the following method. Referring to FIGS. 3 and 4, 1 represents a spinneret having a spinning orifice 2 provided with four arc-shaped slits 3 at the bottom thereof. After being subjected to conventional melting, measuring, filtering and dispensing procedures (not shown), the polyester having incorporated therein the polyoxyalkylene glycol substantially non-reactive with the polyester and the ionic antistatic agent is fed into the spinneret 1 and then, extruded through the spinning orifice 2 and the slits 3. The thus-extruded fiber has a hollow at the center thereof which continuously extends in the longitudinal direction of the fiber. That is, when the molten polyester is extruded through the four arc-shaped slits 3, the four arc-shaped extrudates are bonded with each other at the ends thereof, so as form a hollow continuously extending in the longitudinal direction of the resultant fiber. In the case, the solidification of the molten polyester is started in the vicinity of the portions of the polyester wherein the four arc-shaped extrudates are bonded with each other. As the solidification of the molten polyester proceeds, the formed hollow portion is in the state of reduced pressure. This reduced pressure state causes the polyoxyalkylene glycol to bleed out continuously and easily in the vicinity of the peripheral wall of the hollow. In this case, it is considered that because the area of the region near the peripheral wall of the hollow is small and the ratio of the polyoxyalkylene glycol present in such a small area to the polyoxyalkylene glycol present in the other region becomes high, a substantially continuous layer of the polyoxyalkylene glycol is formed in the vicinity of the peripheral wall of the hollow.

In order to obtain a fiber of a very high antistatic property, the width 5 of the slit 3 may preferably be not more than 0.25 mm.

The shaped of the slit 3 is not limited to the above mentioned arc-shaped. Also, the number of the slits is not limited to four. The slit may be of any shape and the number of the slits may be more or less than four, provided that a hollow continuously extending in the longitudinal direction of the fiber is obtained. In addition, it is not absolutely necessary that the hollow itself is in the form of a concentric circle. The hollow may be in the form of an eccentric circle.

It is very important for the fiber of the present invention that the hollow continuously extends in the longitudinal direction of the fiber. The presence of such hollow is effective for significantly improving the antistatic property of the fiber with the use of the least possible amount of the antistatic agent. It is preferable that the hollow ratio of the hollow is at most 15%, more preferably, at most 4%. When the hollow ratio is more than 15%, the resultant monofilament is liable to undergo fibrillation, which results in a remarkable deterioration in the mechanical properties of the monofilament, as evidenced in the examples described hereinafter. The lower limit of the hollow rate is not particularly specified provided that the hollow continuously extends in the longitudinal direction of the fiber. Generally, it is satisfactory for the intended purpose of the present invention that the hollow rate is at least 0.005%.

It has been found that the fiber of the present invention is excellent in resistance to fibrillation if it has an elongation at breakage of not less than 30%. Such a fiber may be obtained by adjusting the drawing ratio during the production process so that the resulting fiber has such an elongation at breakage.

The antistatic fiber of the present invention should have a hollow in the cross section thereof. The cross sections of the fiber and the hollow may be of any shape, provided that the polyester layer of the fiber continuously extends in the longitudinal direction of the fiber. For example, the cross sections of the fiber and the hollow may be both round-shaped. The cross section of the fiber may be polygonal, while the cross section of the hollow may be circular. Alternatively, the cross section of the hollow may be polygonal. In addition, both the cross section of the fiber and the cross section of the hollow may be of another different shape. The fiber may also have a multiple of, for example, from 2 to 4, hollows.

In the practical preparation of the hollow fiber of the present invention, the molten polyester having incorporated therein two kinds of antistatic agents is extruded through the slit at a speed of from 500 to 2,500 m/min, the undrawn filament is drawn and then, heat-treated. The hollow fiber may also be obtained by extruding the molten polyester having incorporated therein two kinds of antistatic agents through the slit at a speed of from 1,500 to 5,000 m/min, drawing the undrawn filament and false-twisting the drawn filament. The spinning operation may also be carried out at a high speed of more than 5,000 m/min. The drawing operation may be omitted depending on the intended use.

The term "fiber" as used herein refers to both a continuous filament and a staple fiber and may be in any forms such as a twisted yarn, a textured yarn as a spun yarn which is made from these fibers or filaments, and textile materials made from these yarns, such as knitted or woven fabric and non-woven fabric. As is well known, the polyester fiber is often subjected to an alkali treatment causing the weight of the fiber to be reduced in order to improve the hand thereof. The antistatic property of the fiber of the present invention is never influenced by such alkali treatment and instead thereof, it is rather enhanced. When the conventional antistatic fiber is subjected to the alkali treatment, the antistatic agents present in the peripheral surface portion of the fiber are dissolved out, which results in a reduction in the antistatic property of the fiber, as previously described herein. In contrast, because the antistatic fiber of the present invention has the hollow core portion therein, even if the dissolution of the antistatic agents present in the peripheral surface portion of the fiber takes place, the antistatic property of the fiber is not significantly influenced thereby.

In accordance with the present invention, even if the amount of the antistatic agent per weight of the fiber is small, the antistatic property of the fiber is further enhanced because the antistatic agents are concentrated in the vicinity of the peripheral wall of the hollow. On the other hand, in the outer periphery portion surrounding the core portion wherein the antistatic agent is originally present in a small amount, the density of the antistatic agent becomes less, due to the bleeding out of the antistatic agent toward the hollow core portion. Therefore, no substantial decrease in tensile strength and elongation is observed in the hollow antistatic fiber of the present invention, as compared with a fiber made of a homopolymer. Moreover, the hollow antistatic fiber of the present invention is remarkably improved in resistance to fibrillation, dyeing property and color tone over the conventional antistatic fiber.

The present invention will be illustrated in more detail by the following examples. In the examples, the measured values were determined by the following methods.

(1) Hollow ratio:

$$\frac{\text{cross sectional area of hollow}}{\text{cross sectional area of fiber including hollow}} \times 100$$

(2) Electrification friction pressure:

(i) Device and material

A rotary drum type device for determining frictional electricity quantity (rotary static tester).

Oscilloscope

Friction cloth:

cotton broadcloth (30/-) scoured, bleached and finished but not sized (ii) Preparation of a testpiece Rolling type: 3.8 cm×30 cm Metal frame type: 4.0 cm×8.0 cm Three testpieces for each of these types are taken so that the greatest dimension is the longitudinal one. Three pieces of the friction cloth, cotton broadcloth (30/-), measuring 2.5 cm×14.0 cm, are taken so that the greatest dimension is the longitudinal one.

| (iii) Test procedures | |
|---|---|
| ① | Moisture conditioning: the testpieces are allowed to stand in a desiccator at a relative humidity (RH) of 65 ± 2% over one day and one night or more |
| ② | Atmosphere in a measuring chamber: 20 ± 2° C., 65 ± 2% RH |
| ③ | Testpiece: number of superposition one piece |
| ④ | Number of revolutions of the drum: 700 r.p.m. |
| ⑤ | Electrification equilibrium time: one minute |
| ⑥ | Contact pressurizing load: 600 g |

One testpiece is fitted to the rotary drum of the rotary static tester with the right side up. One friction cloth is fitted to clips at the both ends of the lower portion of the drum at a position so that it contacts the testpiece parallel thereto. A load of 600 g is applied on the testpiece. The recorder (5 cm/min), the rotary drum and the oscilloscope are operated in the order indicated. When an electrification equilibrium is reached, the frictional electrification voltage (V) and the polarity (±, −) are read, and these values each are represented as the average of the measurements for the three testpieces (to the second order).

With regard to the relationship between the antistatic effect and the frictional electrification voltage, when the latter is about 2000 V or less, preferably, 1000 V or less, the antistatic effect is satisfactory.

(3) Mechanical deterioration of fiber (fibrillation):

Two testpieces in layers are set on a testing table of a JISLO823 friction testing machine II type. The layered testpieces are rubbed 500 times with a Tetron georgett crepe fabric (white) under a load of 500 g. The rubbed surface of the testpiece is observed after the rubbing operation is complete. The degree of fibrillation is ranked in classes 5, 4, 3, 2, 1 in the order of increasing fibrillation. The number 5 denotes no observation of any fibrillation. When the class is 3 or more, the testpiece involved is considered to be acceptable in practical applications.

(4) Brilliancy:

A testpiece is subjected to an alkali treatment using sodium hydroxide, so as to reduce the weight of the testpiece by about 10% by weight. The brilliancy of the resultant testpiece is visually observed. The dyeing clarify obtained by a testpiece consisting of a polyester fiber with no antistatic agent incorporated thereto is ranked 5. The brilliancy is ranked in classes 5, 4, 3, 2, 1 in the order to decreasing brilliance. When the class is 3 or more, the testpiece involved is considered to be acceptable in practical applications.

EXAMPLE 1

A mixture of 98.8 parts by weight of a polyethylene terephthalate having an intrinsic viscosity of 0.65, determined in O-chlorophenol at a temperature of 25° C., and 1.2 parts by weight of a mixed antistatic agent consisting of a polyoxylethylene glycol having an average molecular weight of 20,000 and sodium alkylsulfonates having an average carbon atom from 12 to 13 in a weight ratio of 2:1 was melted. The resultant melt was fed into the spinneret as shown in FIGS. 3 and 4 at a rate of 19.7 g/mm by means of a gear pump. Then, the melt was extruded through a spinneret having 24 spinning orifices each having a diameter 4 of 1.0 mm and a slit width 5 to 0.15 mm. The extrusion temperature was 295° C. The extruded filaments were taken up on a reel at a speed of 1200 m/min. The undrawn filaments each had one hollow continuously extending in the longitudinal direction thereof at the center thereof. The undrawn filament yarn was fed into a drawing device wherein a feed roller at a temperature of 80° C., a slotted non-contact heater at a temperature of 210° C. and a take-up roller were disposed in the order indicated, and then, drawn at a draw ratio of 2.95 between the feed roller and the take-up roller. The drawn filament yarn was taken up at a speed of 500 m/min. The resultant drawn filament yarn had a denier of 50.1, a tensile strength of 4.2 g/de, an elongation of 42% and a hollow ratio of 1.7%.

Three of the drawn multifilament yarns were converted into a plain knitted fabric having a weight of about 110 g/m$^2$ by using a 20 G knitting machine. The knitted fabric was preset by dry-heating it at a temperature of 180° C. for one minute, thereby to give a gray fabric A. After the preset, the gray fabric A was treated with an aqueous solution of 3% of sodium hydroxide, at the boiling temperature thereof. The decrease in weight of the fabric caused by the alkali treatment was about 10%. Thereafter, the fabric was washed with water and dried, thereby to give a gray fabric B.

The gray fabrics A and B were dyed under the following conditions.

| Dyeing condition |
|---|
| Dye Diamix Blak HG-FS, manufactured by Mitsubishi Kasei Kogyo. K.K.; 10 o.w.f. |
| Nonionic dispersing agent Disper VG, manufactured by Meisei Kasei Kogyo K.K.; 0.5 g/l |
| Bath ratio: 1:50 |
| Dyeing machine: 12 color high pressure dyeing machine (Color Pet) |

-continued

| Dyeing condition |
|---|
| Dyeing temperature and time: 130° C./1 hr |

After the dyeing operation, the dyed fabrics were treated with a neutralizing agent (Bisnhol P-20). Then, the fabrics were laundered and dried in air. Thereafter, the dried fabrics were further dried with hot air at a temperature of from 70° to 80° C. for about 1 hr. From the thus-treated fabrics A and B, testpieces A and B were made, respectively.

The laundering operation was carried out in an automatic reverse washing machine charged with 20 l of warm water having a temperature of 40° C. and 40 g of a commercially available synthetic detergent (Zab, trade name) for 20 minutes. Thereafter, the fabrics were rinsed with flowing water for 20 minutes. The antistatic property (frictional electrification voltage), degree of fibrillation and brilliancy of the testpieces A and B were measured. The results are shown in Table 1, below.

TABLE 1

| | Property | | | |
|---|---|---|---|---|
| Testpiece | Reduction in weight by alkali treatment (%) | Frictional electrification voltage (V) | Resistance to fibrillation (class) | Brilliancy (class) |
| A | Non | 425 | 4.5 | 5.0 |
| B | 9.6 | 588 | 4.0 | 4.5 |

Table 1 clearly indicates that the fiber of the present invention exhibits an excellent antistific property, a high resistance to fibrillation and an excellent dyeing clarify.

The cross-sectional view of the antistatic fiber of the present invention is shown in FIG. 1. FIG. 1 indicates that the polyoxyalkylene glycol bleeds out in the vicinity of the peripheral wall of the hollow in an amount of about 40% of the total weight thereof, and notwithstanding the fiber consists of a single component, the polyoxyalkylene glycol is present in a high density in the vicinity of the peripheral wall of the hollow, so as to form a continuous layer of the glycol in the longitudinal direction of the fiber.

The radius of the hollow core portion was found to be about 30% of the radius of the fiber.

COMPARISON EXAMPLE 1

The same spinning and drawing operations as those described in Example 1 were carried out, except that a conventional spinneret having 24 spinning round orifices each having a diameter of 0.27 mm and a land length of 0.54 mm was used. The resultant drawn filament yarn was of a round cross section and had a denier of 50.0, a tensile strength of 4.3 g/de, and an elongation of 41%. The same knitting, treating and dyeing operations as these described in Example 1 were carried out on the drawn multifilament yarn, thereby to obtain testpieces A and B. The antistatic property (frictional electrification voltage), degree of fibrillation and brilliancy of the testpieces A and B were measured. The results are shown in Table 2, below. These testpieces exhibited poor antistatic property.

TABLE 2

| Testpiece | Property: Reduction in weight by alkali treatment (%) | Frictional electrification voltage (V) | Resistance to fibrillation (class) | Brilliancy (class) |
|---|---|---|---|---|
| A | None | 4838 | 4.5 | 5.0 |
| B | 9.5 | 5013 | 4.5 | 4.5 |

In the case of the fiber obtained in this example, the antistatic agents were almost uniformly dispersed throughout the cross section of the fiber and a substantially continuous layer of the antistatic agents was not formed. Therefore, the antistatic property of the fiber was very inferior.

EXAMPLE 2

In each of experiment Nos. 1 through 26, the same procedures as those described in Example 1 were carried out, except that the extrusion temperature was changed to 290° C., and the amounts of the polyoxyalkylene glycol (A) and the sodium alkylsulfonate (B) were varied as shown in Table 3. The resultant yarn had a hollow ratio of 2.8%.

Also, in each of experiment Nos. 27 through 35, the same procedures of those described in Comparison Example 1 (a solid yarn) were carried out, except that the amounts of (A) and (B) were varied as shown in Table 3.

The encircled numbers of the experiments indicate the present invention. The shown data of the resistance to fibrillation and the brilliancy are data measured after the weight-decreasing treatment.

TABLE 3

| No. | A + B (wt. %) | Ratio of A:B | Elongation at breakage (%) | Frictional electrification voltage (V): Before alkali treatment | After alkali treatment | Resistance to fibrillation (class) | Brilliancy (class) |
|---|---|---|---|---|---|---|---|
| 1 | 1.5 | A alone | 42 | 4380 | 4430 | 5.0 | 5.0 |
| 2 | 3.0 | A alone | 43 | 2535 | 3120 | 3.0 | 4.0 |
| 3 | 5.0 | A alone | 42 | 1810 | 2062 | 2.0 | 2.5 |
| 4 | 1.5 | B alone | 47 | 981 | 3400 | 2.5 | 2.5 |
| 5 | 3.0 | B alone | 40 | 269 | 3265 | 1.5 | 1.5 |
| 6 | 5.0 | B alone | 40 | 110 | 3330 | 1.0 | 1.0 |
| 7 | 0.1 | 1/1 | 43 | 3025 | 3155 | 5.0 | 5.0 |
| 8 | 0.2 | 1/1 | 39 | 1995 | 1910 | 5.0 | 5.0 |
| 9 | 0.2 | 3/1 | 37 | 1910 | 2105 | 5.0 | 5.0 |
| 10 | 0.5 | 3/1 | 42 | 880 | 1275 | 5.0 | 5.0 |
| 11 | 0.6 | 2/1 | 44 | 674 | 1110 | 5.0 | 5.0 |
| 12 | 0.9 | 2/1 | 42 | 480 | 1033 | 4.5 | 4.5 |
| 13 | 0.9 | A alone | 41 | 6985 | 8320 | 5.0 | 5.0 |
| 14 | 0.9 | B alone | 45 | 1135 | 3650 | 3.0 | 3.0 |
| 15 | 1.2 | 3/1 | 43 | 587 | 985 | 4.5 | 4.5 |
| 16 | 1.2 | 4/1 | 40 | 829 | 1090 | 4.5 | 4.5 |
| 17 | 1.5 | 1/1 | 48 | 353 | 1212 | 4.5 | 4.5 |
| 18 | 1.5 | 2/1 | 41 | 447 | 965 | 4.0 | 4.0 |
| 19 | 2.0 | 2/1 | 47 | 349 | 495 | 3.5 | 4.0 |
| 20 | 2.5 | 4/1 | 47 | 680 | 780 | 3.5 | 4.0 |
| 21 | 3.0 | 2/1 | 40 | 165 | 2125 | 3.0 | 3.5 |
| 22 | 3.6 | 2/1 | 46 | 110 | 2780 | 2.0 | 2.5 |
| 23 | 4.2 | 2/1 | 42 | 122 | 2353 | 2.0 | 2.5 |
| 24 | 5.0 | 2/1 | 45 | 105 | 2152 | 1.5 | 1.0 |
| 25 | 6.0 | 2/1 | 38 | 97 | 3007 | 1.0 | 1.0 |
| 26 | 7.0 | 2/1 | 38 | 99 | 2810 | 1.0 | 1.0 |
| 27 | 1.2 | 2/1 | 47 | 7535 | 8475 | 4.5 | 4.5 |
| 28 | 2.0 | 2/1 | 38 | 5825 | 6355 | 4.0 | 4.0 |
| 29 | 3.0 | 2/1 | 42 | 4725 | 5345 | 3.5 | 3.5 |
| 30 | 4.0 | 2/1 | 39 | 1995 | 3055 | 2.5 | 2.0 |
| 31 | 5.0 | 2/1 | 40 | 713 | 3315 | 2.0 | 1.0 |
| 32 | 6.0 | 2/1 | 39 | 268 | 3635 | 2.0 | 1.0 |
| 33 | 7.0 | 2/1 | 45 | 172 | 2595 | 1.0 | 1.0 |
| 34 | 10.0 | 2/1 | 39 | 108 | 2460 | 1.0 | 1.0 |
| 35 | 15.0 | 2/1 | 38 | 79 | 1750 | 1.0 | 1.0 |

From the data shown in Table 3, the following conclusions were reached.

1. In the case of the solid fiber (Nos. 27 through 35), if the amount of the antistatic agent is 3.0% by weight or less (Nos. 27 through 29), little antistatic effect is obtained. The fibers of Nos. 30 through 35 exhibit an improved antistatic property. However, the resistance to fibrillation and the brilliancy of these fibers are not satisfactory for practical use. Also, even in the fibers Nos. 30 through 35, an increase in electrification voltage after the alkali treatment can not be avoided.

2. If A or B alone is added in amount of 3% by weight on less, (Nos. 1, 2, 4, 5, 13 and 14), the intended antistatic effect is scarcely obtained, and the resistance to fibrillation and the brilliancy are remarkably reduced. If A or B alone is added in an amount of 5% (Nos. 3 and 6), the antistatic effect is slightly increased, but the resistance to fibrillation and the brilliancy are further reduced.

3. In contrast, when A is used in combination with B and the total amount of A+B is 0.2 to 3.0% by weight (Nos. 8 through 12 and Nos. 15 through 21), the resultant fiber has a satisfactory resistance to fibrillation and brilliancy for practical purpose and an excellent antistatic property. Above all, the fibers of Nos. 10 through 12 and Nos. 15 through 17 are by no means inferior to a fiber consisting of a polyester alone in respect of physical properties, and at the same time, these fibers exhibit a remarkably enhanced antistatic property.

4. When a combination of A and B is added in an amount exceeding 3.0% by weight, even a hollow fiber exhibits a remarkable reduction in resistance to fibrillation and brilliancy. Therefore, such fiber is not useful for practical purposes.

In each of the hollow fibers, the radius $r_1$ of the hollow core portions, i.e. the portion where the polyoxyalkylene glycol w bled out, and the amount of the polyoxyalkylene glycol present therein were as follows.

TABLE 3-1

| | Radius ($r_1$) [%] | Amount of polyoxyalkylene glycol bled out (wt. %) |
|---|---|---|
| No. 8 | 25 | 45 |
| No. 9 | 35 | 35 |
| No. 10 | 35 | 35 |
| No. 11 | 30 | 40 |
| No. 12 | 30 | 40 |
| No. 15 | 35 | 35 |
| No. 16 | 35 | 30 |
| No. 17 | 25 | 45 |
| No. 18 | 30 | 40 |
| No. 19 | 30 | 40 |
| No. 20 | 35 | 30 |
| No. 21 | 30 | 40 |

The radius $R_1$ is represented in terms of a percentage (5) relative to the radius r of the fiber. The amount of polyoxyalkylene glycol bled out is calculated by the following equation:

$$\frac{\text{polyoxyalkylene glycol contained in the hollow core portion}}{\text{total polyoxyalkylene glycol contained in the fiber}} \times 100(\%)$$

EXAMPLE 3

In each of experiments, the same procedures as those described in Example 1 were carried out, except that the hollow ratio was varied as shown in Table 4, below. The results are shown in Table 4.

TABLE 4

| No. | Hollow ratio (%) | Elongation at breakage (%) | Frictional electrification voltage (V) Before alkali treatment | After alkali treatment | Resistance to fibrillation (class) | Brilliancy (class) |
|---|---|---|---|---|---|---|
| 36 | 0.02 | 41 | 1913 | 1987 | 4.5 | 4.5 |
| 37 | 0.05 | 1235 | 1070 | 4.5 | 4.5 | |
| 38 | 0.1 | 42 | 862 | 780 | 4.5 | 4.5 |
| 39 | 0.2 | 39 | 627 | 665 | 4.5 | 4.5 |
| 40 | 0.38 | 40 | 611 | 680 | 4.5 | 4.5 |
| 41 | 0.6 | 38 | 730 | 875 | 4.0 | 4.0 |
| 42 | 0.8 | 39 | 410 | 560 | 4.0 | 4.0 |
| 43 | 1.5 | 45 | 403 | 580 | 4.0 | 4.0 |
| 44 | 3.4 | 39 | 358 | 510 | 3.5 | 4.0 |
| 45 | 4.5 | 41 | 380 | 575 | 3.5 | 4.0 |
| 46 | 8 | 37 | 250 | 551 | 3.0 | 3.5 |

TABLE 4-continued

| No. | Hollow ratio (%) | Elongation at breakage (%) | Frictional electrification voltage (V) Before alkali treatment | After alkali treatment | Resistance to fibrillation (class) | Brilliancy (class) |
|---|---|---|---|---|---|---|
| 47 | 15 | 43 | 253 | 553 | 3.0 | 3.0 |
| 48 | 20 | 43 | 215 | 535 | 2.5 | 2.5 |
| 49 | 30 | 39 | 226 | 548 | 2.0 | 2.5 |

In each of the experiments, the change of the hollow ratio was carried out under the following conditions.

TABLE 5

| | Intrinsic viscosity of polyethylene terephthalate | Moisture content of tip (%) | Extrusion temperature (°C.) | Slit width (mm) |
|---|---|---|---|---|
| No. 36 | 0.60 | 0.005 | 300 | 0.20 |
| No. 37 | 0.60 | 0.005 | 300 | 0.20 |
| No. 38 | 0.60 | 0.005 | 295 | 0.20 |
| No. 39 | 0.60 | 0.005 | 295 | 0.20 |
| No. 40 | 0.65 | 0.009 | 300 | 0.15 |
| No. 41 | 0.65 | 0.004 | 300 | 0.20 |
| No. 42 | 0.65 | 0.004 | 300 | 0.15 |
| No. 43 | 0.65 | 0.003 | 295 | 0.15 |
| No. 44 | 0.65 | 0.003 | 288 | 0.15 |
| No. 45 | 0.65 | 0.003 | 285 | 0.15 |
| No. 46 | 0.72 | 0.007 | 295 | 0.20 |
| No. 47 | 0.72 | 0.003 | 290 | 0.15 |
| No. 48 | 0.72 | 0.003 | 285 | 0.15 |
| No. 49 | 0.72 | 0.003 | 285 | 0.08 |

From the data shown in Table 4, the following conclusions are obtained.

1. When the hollow ratio is at most 15% and the total amount of the polyoxyalkylene glycol and the ionic antistatic agent is 3% by weight or less, an outstanding improvement is mode in respect of all of the antistatic property, the resistance to fibrillation and brilliancy.

2. Even if the above mentioned total amount is 3% by weight or less, when the hollow ratio is more than 15%, the resultant fiber exhibits a poor resistance to fibrillation and brilliancy which is unsuitable for practical purposes.

3. Even if the above mentioned total amount is 3% by weight or less, when the resultant fiber contains no continuous hollow, a satisfactory improvement in antistatic property for practical purposes in not attained.

EXAMPLE 4

The procedure as described in Example 1 was repeated, except that the used amounts of polyoxyalkylene glycol (A) and the sodium akylsufonate (B), the extrusion amount and the drawing ratio were varied, to obtain a hollow fiber of a hollow ratio of 2.9%. The results are shown in Table 6.

TABLE 6

| No. | A + B (wt. %) | Ratio of A:B | Elongation at breakage (%) | Frictional electrification voltage (V) Before alkali treatment | After alkali treatment | Resistance to fibrillation (class) | Brilliancy (class) |
|---|---|---|---|---|---|---|---|
| 50 | 0.6 | 2/1 | 9 | 871 | 849 | 2.5 | 5.0 |
| 51 | " | " | 19 | 831 | 883 | 2.5 | 5.0 |
| 52 | " | " | 30 | 862 | 908 | 3.5 | 5.0 |
| 53 | " | " | 37 | 879 | 883 | 4.5 | 5.0 |
| 54 | " | " | 42 | 800 | 913 | 4.5 | 5.0 |
| 55 | " | " | 55 | 858 | 980 | 4.5 | 5.0 |
| 56 | 1.2 | 2/1 | 11 | 479 | 598 | 2.0 | 4.5 |
| 57 | " | " | 22 | 475 | 520 | 2.5 | 4.5 |
| 58 | " | " | 31 | 339 | 516 | 3.0 | 5.0 |
| 59 | " | " | 37 | 311 | 656 | 3.5 | 5.0 |

TABLE 6-continued

| No. | A + B (wt. %) | Ratio of A:B | Elongation at breakage (%) | Frictional electrification voltage (V) Before alkali treatment | After alkali treatment | Resistance to fibrillation (class) | Brilliancy (class) |
|---|---|---|---|---|---|---|---|
| 60 | " | " | 41 | 487 | 583 | 4.5 | 5.0 |
| 61 | " | " | 50 | 423 | 629 | 4.5 | 5.0 |
| 62 | 1.8 | 2/1 | 11 | 363 | 734 | 1.5 | 4.0 |
| 63 | " | " | 21 | 338 | 707 | 2.5 | 4.0 |
| 64 | " | " | 33 | 347 | 669 | 3.0 | 4.0 |
| 65 | " | " | 44 | 445 | 694 | 4.5 | 4.5 |
| 66 | " | " | 49 | 357 | 637 | 4.5 | 4.5 |
| 67 | " | " | 56 | 409 | 648 | 4.5 | 4.5 |

EXAMPLE 5

A mixture of 98.8 parts by weight of a polyethylene terephthalate having an intrinsic viscosity of 0.65, determined in O-chlorophenol at a temperature of 25° C., and 0.8 parts by weight of a mixed antistatic agent consisting of a polyoxyethylene glycol having an average molecular weight of 20,000 and an anionic antistatic agent as indicated in Table 5 in a weight ratio of 2:1 was melted. The resultant melt was fed into the spinneret as shown in FIGS. 3 and 4 by means of a gear pump. Then, the melt was extruded through a spinneret having 24 spinning orifices each having a diameter 4 of 1.0 mm and a slit width 5 of 0.20 mm. The extrusion temperature was 300° C. The extruded filaments were taken up on a reel at a speed of 1500 m/min. The undrawn filaments each had one hollow continuously extending in the longitudinal direction thereof at the center thereof. The undrawn filament yarn was fed into a drawing device wherein a feed roller at a temperature of 80° C., a slotted non-contact heater at a temperature of 200° C. and a take-up roller were disposed in the order indicated, and then, drawn at a draw ratio of 2.55 between the feed roller and the take-up roller. The drawn filament yarn was taken up at a speed of 600 m/min. The resultant drawn filament yarn had a denier of 50.3, a tensile strength of 4.0 g/de, an elongaion of 40% and a hollow ratio of 1.1%.

The drawn multifilament yarn was converted into a knitted fabric according to the same knitting procedure as that described in Example 1. The physical properties of the knitted fabric were evaluated. The results are shown in Table 7.

TABLE 7

| No. | Anionic antistatic agent | Frictional electrification voltage (V) Resistance to Before alkali treatment | After alkali treatment | Brilliancy fibrillation (class) | (class) |
|---|---|---|---|---|---|
| 50 | (a) | 530 | 747 | 4.5 | 4.5 |
| 51 | (b) | 539 | 728 | 4.5 | 4.5 |
| 52 | (c) | 522 | 760 | 4.5 | 4.5 |
| 53 | (d) | 533 | 755 | 4.5 | 4.5 |

(a) sodium dodecylbenzenesulfonate
(b) potassium dodecylbenzenesulfonate
(c) sodium nonylbenzenesulfonate
(d) sodium 3-nonylphenoxypropanesulfonate

We claim:

1. An antistatic polyester fiber composed of a single polymeric component, having at least one hollow core extending along the longitudinal axis thereof, the hollow ratio being at most 15%, and containing (a) a polyoxyalkylene glycol substantially non-reactive with said polyester and (b) an ionic antistatic agent, dispersed through the fiber in an amount of at most 3% by weight based on the weight of the fiber, characterized by the presence of a highly conductive portion formed by the dispersion of said polyoxyalkylene glycol around said hollow core in a high density and further characterized in that the ionic antistatic agent is almost uniformly dispersed throughout the cross-section of the fiber.

2. An antistatic polyester fiber as claimed in claim 1, wherein the single component is a polyethylene terephthalate.

3. An antistatic polyester fiber as claimed in claim 1, wherein the hollow core ratio is 4% or less.

4. An antistatic polyester fiber as claimed in claim 1, wherein a plurality of hollow cores are present along the longitudinal axis of the fiber.

5. An antistatic polyester fiber as claimed in claim 1, wherein the polyoxyalkylene glycol has a molecular weight of 5000 or more.

6. An antistatic polyester fiber as claimed in claim 1, wherein the ionic antistatic agent contains a group of the formula: $—SO_3M$ wherein M represents an alkali metal.

7. An antistatic polyester fiber as claimed in claim 6, wherein the ionic antistatic agent is represented by the formula: $RSO_3M$ wherein R represents a radical selected from the group consisting of alkyl, aryl and aralkyl radicals, and M represents an alkali metal.

8. An antistatic polyester fiber as claimed in claim 1, wherein the content of the polyoxyalkylene glycol and the ionic antistatic agent is in a range of from 0.5 to 1.5% by weight.

9. An antistatic polyester fiber as claimed in claim 1 or 8, wherein the weight ratio of polyoxyalkylene glycol to ionic antistatic agent is in a range of from 9:1 to 1:1.

10. An antistatic polyester fiber as claimed in claim 1, wherein the radius of the hollow core portion is a half or less of the radius of the fiber.

11. An antistatic polyester fiber as claimed in claim 1, wherein at least 30% by weight of the polyoxyalkylene glycol is dispersed in said conductive portion.

12. An antistatic polyester fiber as claimed in claim 1, having an elongation at breakage of not less than 30%.

* * * * *

UNITED STATES PATENT OFFICE
CERTIFICATE OF CORRECTION

Patent No. 4,357,390 Dated November 2, 1982

Inventor(s) Kiyotaka Ozaki, et al

It is certified that error appears in the above-identified patent and that said Letters Patent are hereby corrected as shown below:

Column 2, line 61: "imported" should be --imparted--

Column 3, line 47: "spurn" should be --spun--

Column 6, line 63: "oxyalkylen" should be --oxyalkylene--

Column 11, line 10: "clarify" should be --clarity--

Signed and Sealed this

*Twenty-third* Day of *August 1983*

[SEAL]

*Attest:*

GERALD J. MOSSINGHOFF

*Attesting Officer*

*Commissioner of Patents and Trademarks*